United States Patent [19]

Kirk et al.

[11] 4,095,630

[45] Jun. 20, 1978

[54] WOOD LATHE CUTTING TOOL

[76] Inventors: Chester E. Kirk, 727 NW. 16th St., Corvallis, Oreg. 97330; Owen E. Raab, 11825 Glendale Way South, Seattle, Wash. 98168

[21] Appl. No.: 780,082

[22] Filed: Mar. 22, 1977

[51] Int. Cl.[2] ..... B27C 7/06

[52] U.S. Cl. ..... 142/56

[58] Field of Search ..... 142/56

[56] References Cited

U.S. PATENT DOCUMENTS

| | | | |
|---|---|---|---|
| 232,634 | 9/1880 | Durgin | 142/56 |
| 1,368,119 | 2/1921 | Cockcroft | 142/56 X |
| 1,478,300 | 12/1923 | Sage | 142/56 |
| 2,986,177 | 5/1961 | Markin | 142/56 |

*Primary Examiner*—Donald G. Kelly

*Attorney, Agent, or Firm*—D. Paul Weaver

[57] ABSTRACT

A cutting tool for wood turning lathes comprises a unitized elongated bar-like assembly which is operated in a vertical plane without the need for the customary tool rest. Control and safety are enhanced. The cutting tool has an adjustable rocker foot at its lower end enabling the height of the tool cutting bits to be adjusted relative to the turning work. A bit holder containing plural circumferentially spaced bits is locked removably between two body members and it is merely necessary to rotate the cutting tool on its longitudinal axis for bringing a new bit into engagement with the work.

10 Claims, 5 Drawing Figures

FIG. 4
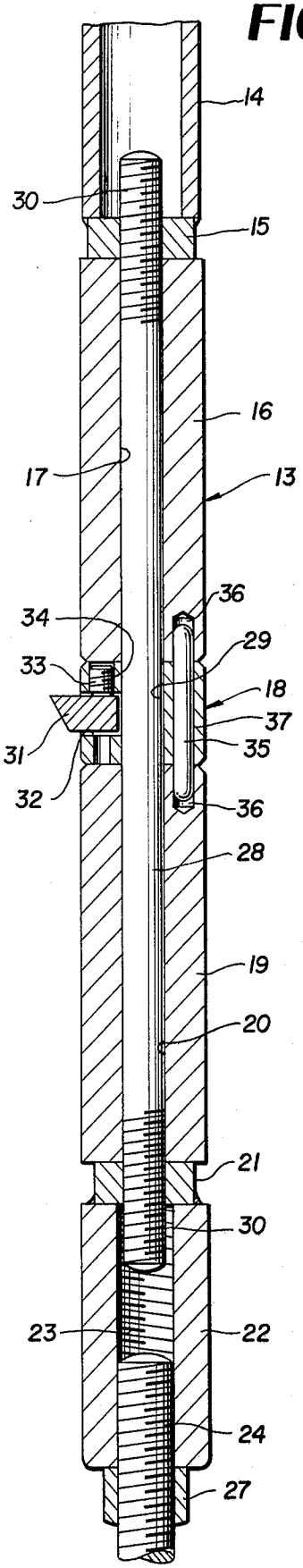
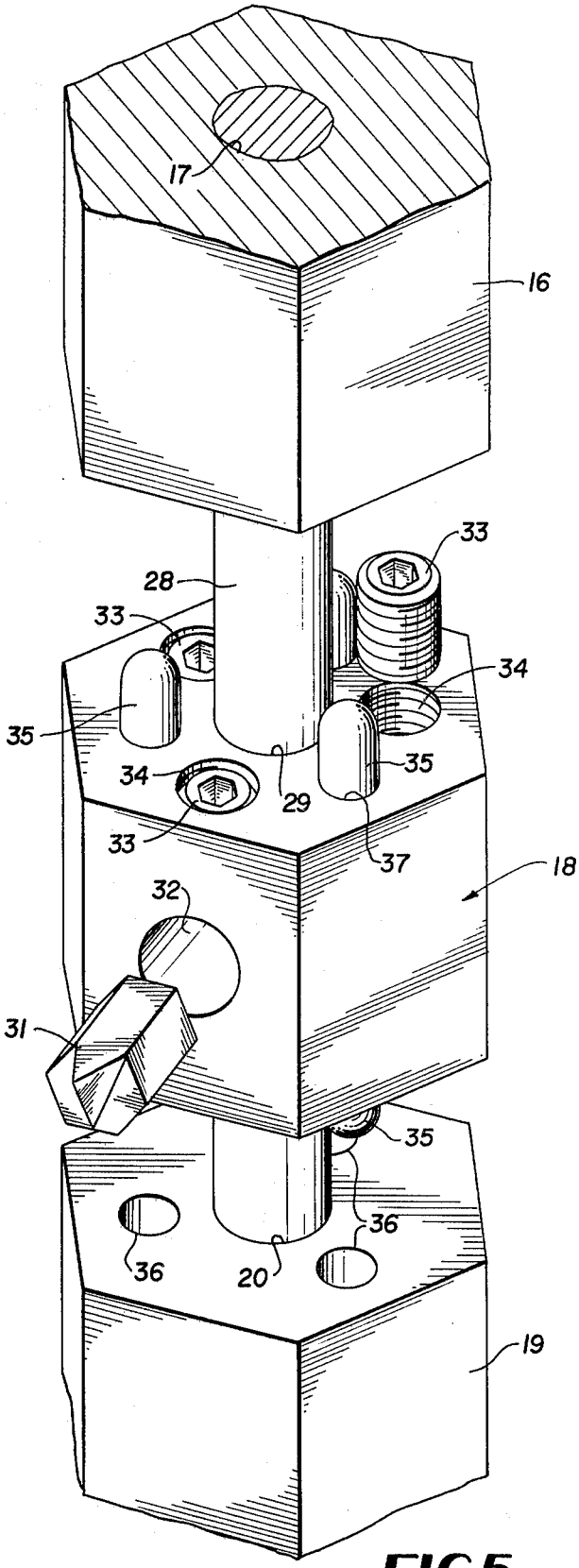
FIG. 5

WOOD LATHE CUTTING TOOL

BACKGROUND OF THE INVENTION

Traditional cutting tools for wood lathes involve the use of a stationary tool rest positioned near one side of the rotating work and the tool is placed on this rest and arranged in a generally horizontal position while being manipulated by the hands. The customary tool crosses the rest and the cutting tool tip or bit is brought into engagement with the rotating work to produce the desired cutting or shaping thereof. The proper use of the traditional wood lathe cutting tool with a tool rest requires a good bit of skill and can, in some situations, be quite dangerous. It is difficult to regulate the amount of cut and if a hard grain area, knot, or crack is encountered, the cutting tool can literally be jerked from the operator's hand causing the risk of serious injury.

One of the prime objectives of the present invention is to completely eliminate this hazard and to also eliminate the necessity for the tool rest. The cutting tool of the invention is a bar-like member which is used in a generally vertical position, rather than horizontally, and rocked or pivoted about its bottom end while such end is engaged with any solid support. Multiple tool bits extend radially from the cutting tool at the elevation of the turning work and can be selectively brought into engagement with the work by simply rotating the tool on its longitudinal axis and rocking it about its stabilized lower end or foot. Much greater control of cutting is thereby achieved, and the tool is much safer to use than prior art types.

Some examples of the known prior art are shown in U.S. Pat. Nos. 186,701; 850,874; 1,175,283 and 1,478,300.

Another important aspect of the invention which the prior art does not provide is much greater freedom in the operation or manipulation of the cutting tool, the tool not being restricted by the customary tool rest. It is also much simpler to change the cutting profile merely by rotating the tool on its axis to present a different cutting bit. In the customary prior art, when a new cutting shape or profile is desired, the operator must put aside one chisel or tool and pick up another one. The invention is considerably more efficient and convenient.

Since the cutting bits on the present bar-type tool are small, the user can take a full depth cut without fear of gouging or ruining the work. Greater control can be exercised, as stated, through an improved mode of operation. The tool of the invention can do the work which would normally require the use of several different or separate tools.

BRIEF DESCRIPTION OF THE DRAWINGS

FIG. 4 is an enlarged fragmentary vertical section taken on line 4—4 of FIG. 2.

FIG. 5 is a fragmentary exploded perspective view of the tool showing the tool bit holder and associated parts.

DETAILED DESCRIPTION

Figure 1:
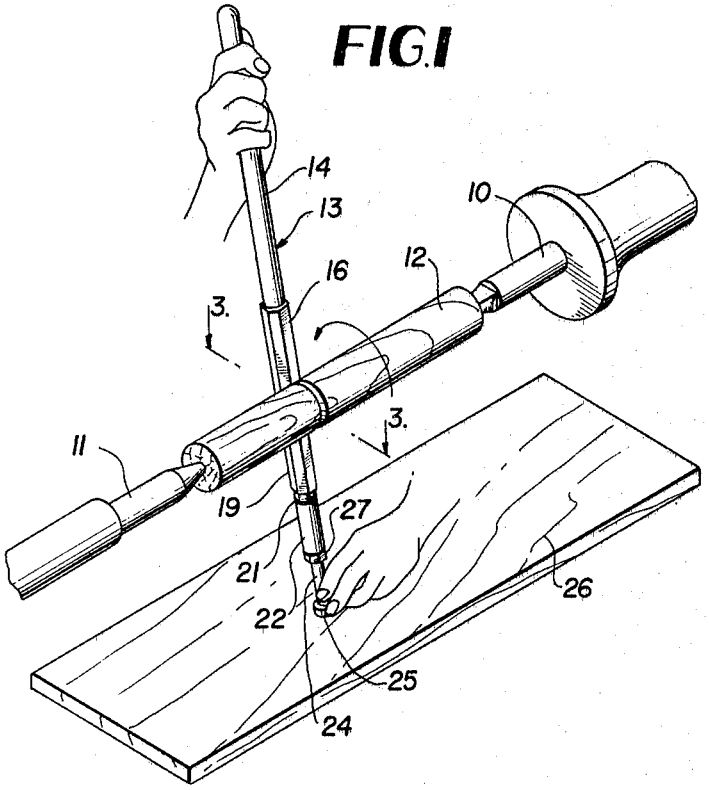
FIG. 1 is a perspective view of a wood lathe cutting tool embodying the invention.
Figure 2:
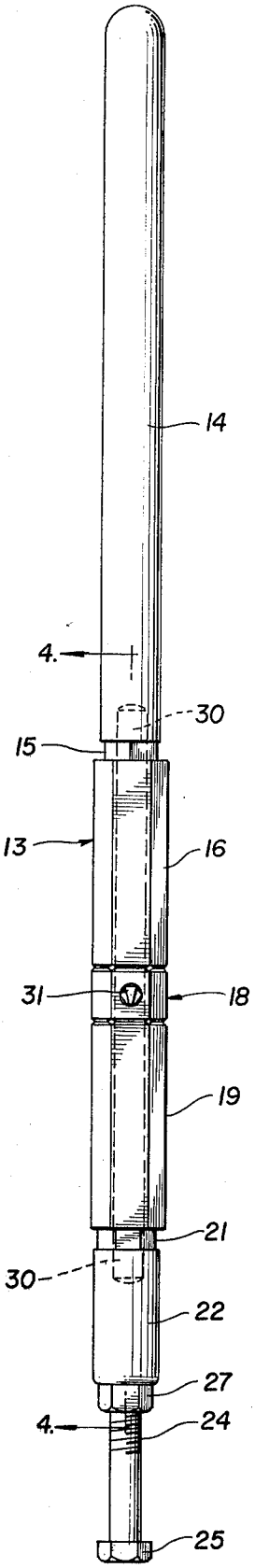
FIG. 2 is a side elevation thereof on an enlarged scale.
Figure 3:
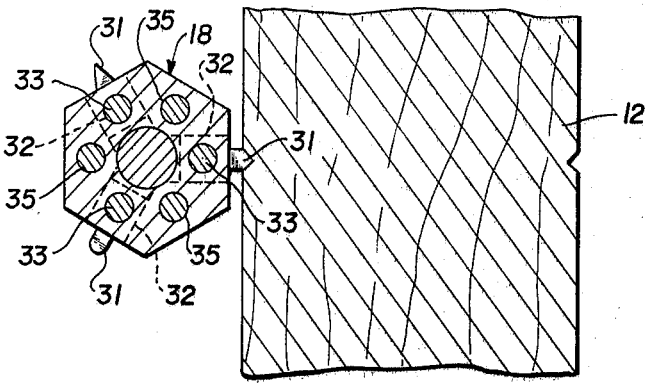
FIG. 3 is an enlarged horizontal section taken on line 3—3 of FIG. 1.

Referring to the drawings in detail wherein like numerals designate like parts, a wood lathe is shown in FIG. 1 including a live center 10 and a dead center 11 for supporting and rotating a wooden workpiece 12 to be acted on by the tool 13 forming the subject matter of this invention.

The tool proper is an elongated bar-like assembly comprising a handle 14 of convenient length having a nut 15 welded to its lower end. Below the nut 15 in the assembled tool, an upper tool body section 16, preferably of hexagonal cross section, is provided and this upper body section has a central axial through bore 17 extending from end-to-end thereof. Immediately below the upper body section 16 is a comparatively short hexagonal tool bit holder 18, and below this element is a hexagonal lower body section 19 also having an axial through bore 20. Below the lower body section 19 is another nut 21 welded to the upper end of an adjustment foot receiver 22 which may be cylindrical. The receiver 22 has a threaded through bore 23 for the reception of a threaded adjusting shank 24 of a bolt whose head 25 forms a rocker foot or engaging element for the lower end of the cutting tool. As shown in FIG. 1, the rocker foot 25 may engage any solid support, such as a wooden plank 26.

The adjusting bolt or shank 24 at the bottom of the tool is locked to the receiver 22 in the selected adjusted position by a locking nut 27. A center axial tool body securing rod 28 extends entirely through the bores 17 of body sections 16 and 19 and through a center axial bore 29 of tool bit holder 18. Opposite end portions 30 of the rod 28 are threaded for engagement with the nuts 15 and 21 carried by the handle 14 and receiver 22. Thus, when the nuts 15 and 21 are tightened against the end faces of body sections 16 and 19, these elements firmly clamp the tool bit holder 18 between them and the entire assembly is rendered rigid and unitized.

The bit holder 18 has preferably three equidistantly spaced tool bits 31 of different cutting shapes with each bit held in a radial socket 32 of the holder 18 by a set screw 33 received in a threaded opening 34 in the top end face of the holder 18. Each tool bit emerges through one flat face of the hexagonal holder 18 centrally of such face, as shown in the drawings. The set screws 33 rigidly lock the bits 31 removably and interchangeably in their sockets 32 which are intersected at right angles by the threaded openings 34.

Between the openings 34 in circumferentially spaced relation are preferably three axial alignment and positioning pins 35 on the tool bit holder 18 which project above and below the opposite end faces of the holder 18 and engage within socket openings 36 formed in the opposing end faces of body sections 16 and 19. The pins 35 may be press-fitted into bores 37 of the holder 18. The three pins 35 form a positive driving connection between the bit holder 18 and the tool body sections 16 and 19.

In view of the foregoing description, the operation of assembling and disassembling the lathe cutting tool should be completely clear to anyone skilled in the art. The height of the cutting bits 31 relative to the work 12 is easily adjusted by extension or retraction of the bolt 24 relative to the receiver 22. In order to change bits 31 during work cutting, it is merely necessary to rotate the cutting tool 120° on its longitudinal axis. A wide variety of bits 31 may be utilized in the holder 18.

As illustrated in FIG. 1, to use the tool, the rocker foot 25 is merely placed on the support 26 formed preferably of wood or the like so that the foot can have a good purchase or bite and will not tend to slip. With the tool adjusted to the proper height and securely locked, the operator simply grasps the handle 14 and swings the tool into cutting engagement with the turning workpiece 21, by rocking the entire rigid bar-like assembly around the foot element 25. Since the tool bits 31 are small, a full depth cut with any bit can be safely made with the tool, as previously explained. The tool is utilized in a near vertical position without the customary tool rest. The mode of operation is simpler and affords a greater degree of control over the cutting tool, is safer and more convenient. A lesser degree of skill is required to use the tool of this invention compared to prior art tools.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A wood lathe cutting tool comprising an elongated rigid bar-like assembly for use in a generally vertical position in relation to a horizontally rotating workpiece, the lower end of said bar-like assembly adapted to be freely engaged rockably with a solid support below the rotating workpiece, whereby the cutting tool can be manually rocked in a vertical plane about its lower end toward and away from the rotating workpiece while the tool is being gripped near its upper end, and a tool bit means on said bar-like assembly between the upper and lower ends thereof at a proper height to enable the tool bit means to engage and cut into the rotating workpiece, said tool bit means including a bit element projecting radially beyond the bar-like assembly.

2. A wood lathe cutting tool as defined in claim 1, and said tool bit means including a multiple tool bit holder for bits of different cutting profiles which are removably secured in the holder.

3. A wood lathe cutting tool as defined in claim 1, wherein said rigid bar-like body is a sectional body having axial screw-threaded coupling means for the sections thereof, said sections including an upper end handle, a lower end adjustable foot piece and said tool bit means being disposed between the upper end handle and said foot piece, and the tool bit means including a holder for at least one radially extending tool bit.

4. A wood lathe cutting tool as defined in claim 1, and an extensible and retractable foot element on the lower end of said assembly enabling the length of the assembly and the height of said tool bit means to be adjusted relative to a rotating workpiece.

5. A wood lathe cutting tool as defined in claim 1, and said bar-like assembly comprising an upper end handle member, a lower longitudinally adjustable and lockable foot piece, a pair of body sections interposed between said handle member and foot piece, and said tool bit means including a bit holder interposed between said body sections , and screw-threaded connector means for said handle member, foot piece, body sections and bit holder whereby the latter may be locked together rigidly in end-to-end abutting relationship to form said rigid bar-like assembly.

6. A wood lathe cutting tool as defined in claim 5, and said body sections and bit holder having aligned bores, a securing rod extending through said bores axially of said tool and having threaded end portions, and nut elements fixed on said handle member and said foot piece and having screw-threaded engagement with the threaded end portions of said securing rod.

7. A wood lathe cutting tool as defined in claim 6, and said foot piece comprising a screw-threaded receiver attached to one of said nut elements, and an axially adjustable bolt engaged with said threaded receiver and being extensible and retractable relative thereto to increase or decrease the length of said tool and adjust the height of said bit holder.

8. A wood lathe cutting tool as defined in claim 7, and a locking nut on said adjustable bolt engageable with one end of said threaded receiver.

9. A wood lathe cutting tool as defined in claim 5, and said bit holder comprising a block-line element having radial bit receiving sockets in circumferentially spaced relationship, bit retaining set screws in one end face of said holder intersecting said sockets, and at least one axially extending bit holder locator and drive pin in said holder and projecting beyond the end faces of the holder, the opposing end faces of said body sections having socket openings receiving the opposite end portions of said pin.

10. A wood lathe cutting tool as defined in claim 9, and said body sections and bit holder being hexagonal in cross section, and said bit receiving sockets being formed in three equidistantly spaced flat side faces of said holder.

* * * * *